US006234833B1

(12) United States Patent
Tsai et al.

(10) Patent No.: US 6,234,833 B1
(45) Date of Patent: May 22, 2001

(54) RECEPTACLE ELECTRICAL CONNECTOR ASSEMBLY

(75) Inventors: Hui Tze Tsai; Nan Tsung Huang; Kun-Tsan Wu, all of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/472,722

(22) Filed: Dec. 27, 1999

(30) Foreign Application Priority Data

Dec. 3, 1999 (CH) ..... 088121230

(51) Int. Cl.[7] ..... H01R 12/20
(52) U.S. Cl. ..... 439/541.5; 439/188
(58) Field of Search ..... 439/541.5, 188, 439/944, 607, 609, 79

(56) References Cited

U.S. PATENT DOCUMENTS 5,417,585 * 5/1995 Morin et al. ..... 439/541.5
5,462,445 * 10/1995 Anhalt ..... 439/944
5,613,880 * 3/1997 Wang ..... 439/541.5
5,709,554 * 1/1998 Savage, Jr. ..... 439/541.5

* cited by examiner

*Primary Examiner*—Gary F. Paumen
(74) *Attorney, Agent, or Firm*—Wei Te Chung

(57) ABSTRACT

A receptacle electrical connector assembly of the present invention comprises a main frame, three electrical connectors, a first and a second side cover positioned on both sides of the electrical connector assembly, a first group of terminals, a second group of terminals, and a grounding terminal mounted on the first side cover and a third group terminal mounted on the second side cover, and a shield covering a front of the receptacle electrical connector assembly. The main frame defines three receiving cavities. Each electrical connector has a housing and a set of contacts retained in the housing which is designed to mate with an inserted audio jack. The contacts comprising a first contact, a second contact, a grounding contact, and a pair of switch contacts. Each contact further defines a contacting portion, and the contacting portions of the grounding contacts of the three electrical connectors projecting from same sides of the housings, the contacting portions of the contacts of the middle electrical connector projecting from the other side of associated housing. Each terminal engages with the contacting portion of a corresponding contact. In assembly, a grounding terminal, and the terminals for the top and bottom electrical connectors are mounted at a side of the receptacle electrical connector assembly, and the terminals for the middle electrical connector are mounted at the other side thereof.

1 Claim, 12 Drawing Sheets

RECEPTACLE ELECTRICAL CONNECTOR ASSEMBLY

BACKGROUND OF THE INVENTION

The present invention relates to an electrical connector assembly, and particularly to a receptacle electrical connector assembly having contact received therein.

Taiwan Patent Application Nos. 82202920, 82204992 and 81212225 disclose several electrical connector assemblies. These connector assemblies all comprise a stacked connector module having several housings, a set of terminals receiving in each housing, and a grounding plate mounted in a front of each housing. Because the height of these connector assemblies is greater than that of an ordinary connector, the terminals received in these connectors are longer than these received in an ordinary connectors. Additionally, the terminals for each housing have different lengths and different construction, and need different dies to manufacture them. Therefore the manufacture of these terminals can be very costly and laborious. In addition, the upper terminals all have a longer tail to extend to the printed circuit board, so in punching these terminals, a great amount of carrier material is wasted. The construction of the terminals received in the connector are too different to be interchangeable with each other. Hence, an improved receptacle electrical connector assembly is required to overcome the disadvantages of the prior art.

BRIEF SUMMARY OF THE INVENTION

A first object of the present invention is to provide a receptacle electrical connector assembly having a plurality of contacts with a similar structure which facilitates the manufacture thereof and lowers cost;

A second object of the present invention is to provide a receptacle electrical connector assembly having contacts projecting from both sides of component electrical connectors to facilitate assembly.

Accordingly, a receptacle electrical connector assembly of the present invention comprises a main frame, three electrical connectors, a first and a second side cover positioned on both sides of the electrical connector assembly, a first group of terminals, a second group of terminals, and a grounding terminal mounted on the first side cover and a third group terminal mounted on the second side cover, and a shield covering a front of the receptacle electrical connector assembly. The main frame defines three receiving cavities. Each electrical connector has a housing and a set of contacts retained in the housing which is designed to mate with an inserted audio jack. The contacts comprising a first contact, a second contact, a grounding contact, and a pair of switch contacts. Each contact further defines a base portion, a pair of sidebars extending from the base portion, and a contacting portion extending from one sidebar, and the contacting portion is adapted to project from either side of the housing. The contacting portions of the grounding contacts of the three electrical connectors projecting from same sides of the housings, and the contacting portions of the contacts of the middle electrical connector projecting from the other side of associated housing. Each terminal engages with the contacting portion of a corresponding contact. In assembly, a grounding terminal, and the terminals for the top and bottom electrical connectors are mounted at a side of the receptacle electrical connector assembly, and the terminals for the middle electrical connector are mounted at the other side thereof. The contacting portion of the contact of the upper, the lower, and the middle electrical connectors are positioned on the corresponding side.

Other objects, advantages and novel features of the invention will become more apparent from the following detailed description of the present embodiment when taken in conjunction with the accompanying drawings.

DETAILED DESCRIPTION OF THE INVENTION

Figure 1:
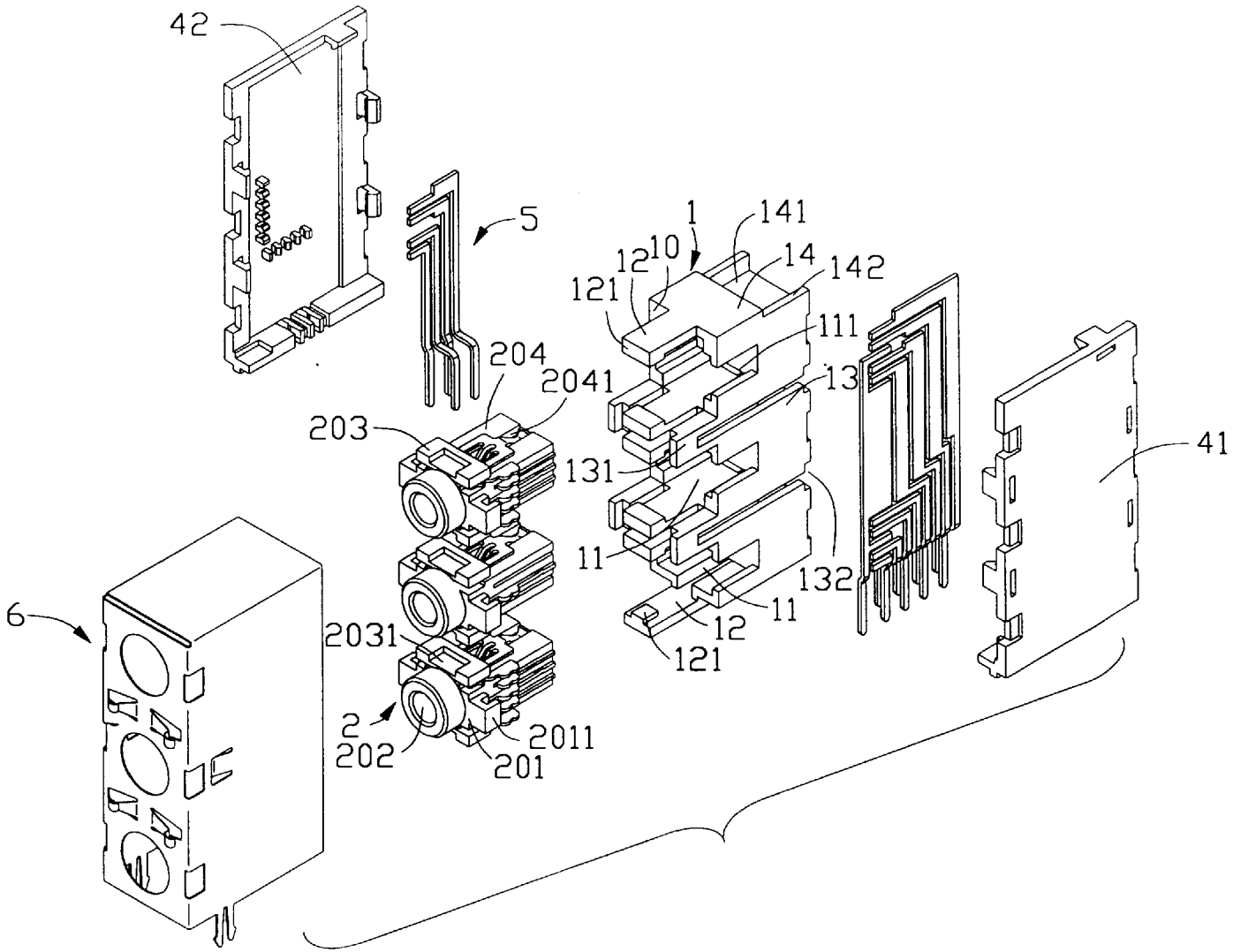
FIG. 1 is an exploded view of a receptacle electrical connector assembly in accordance with the present invention.

Referring to FIG. 1, a receptacle electrical connector assembly in accordance with the present invention comprises an insulative main frame 1 having three receiving cavities 11, three electrical connectors 2 received in corresponding receiving cavities 11, a first side cover 41, a second side cover 42, a set of terminals 5 mounted on both the first side cover 41 and the second side cover 42, and a conductive shield 6 covering a front of the receptacle electrical connector assembly.

The main frame 1 is roughly rectangular, and comprises a plurality of front portions 10, three pairs of opposing locking arms 12 extending forward from the front portion 10, a plurality of opposing sidewalls 13, a plurality of top surfaces 14, and three receiving cavities 11 defined within each pair of defined within each pair of sidewalls 13, and a top surface 14, and a pair of the locking arm 12. A pair of gaps 111 is defined in each pair of sidewalls 13. A clipping bar 131 extends forward from adjacent pairs of sidewalls 13 and between adjacent gaps 111, and an indentation 132 is defined between adjacent sidewalls 13 opposite each clipping bar 131. A top recess 141 is defined at a top rear of the main frame 1.

Figure 2:
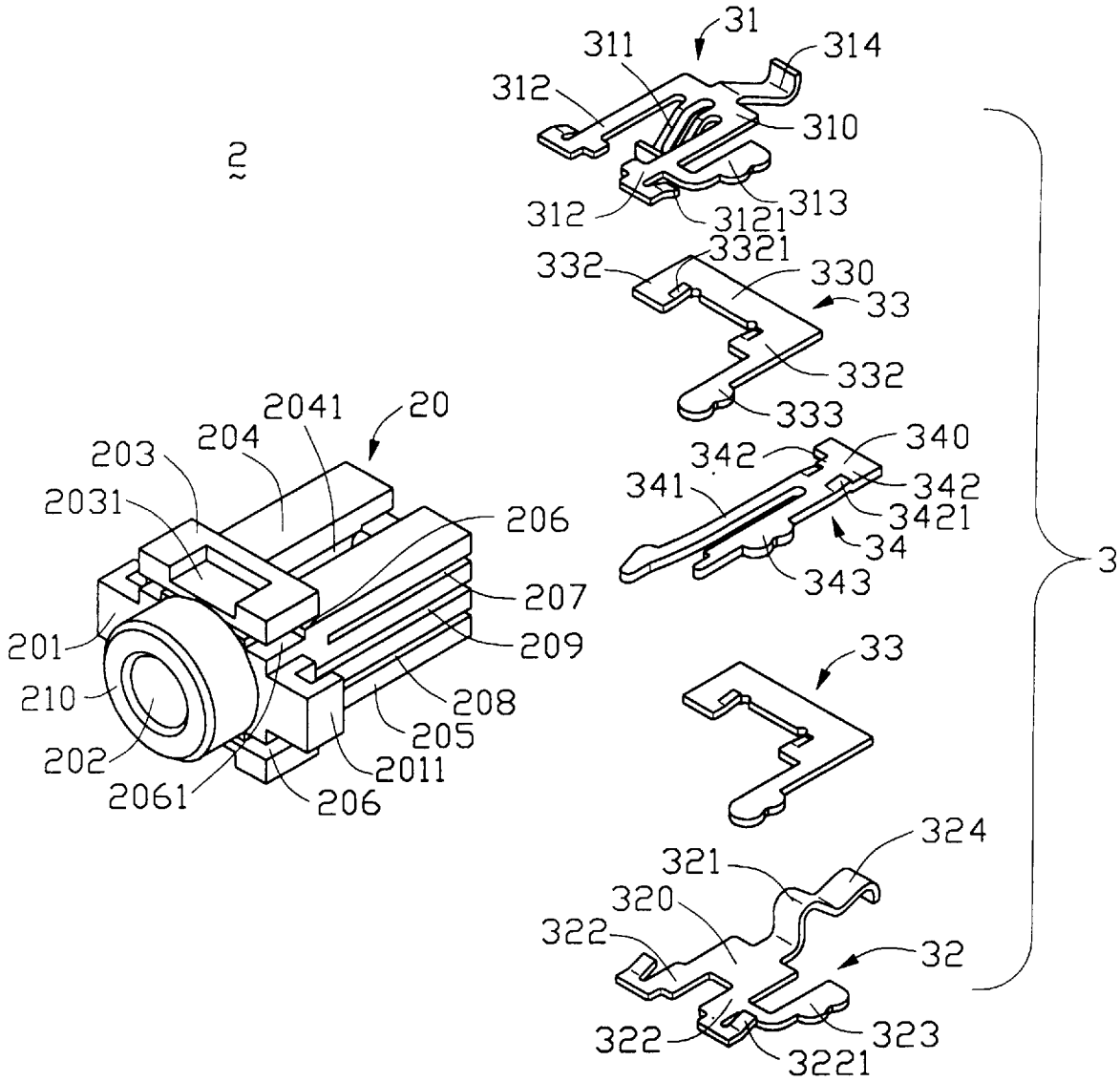
FIG. 2 is a exploded view of an electrical connector of FIGS. 1.
Figure 3A:
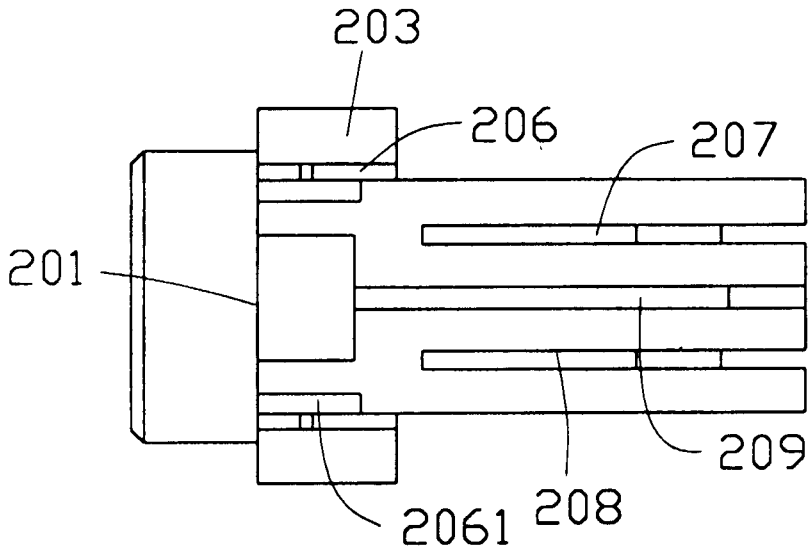
FIGS. 3A and 3B are a side and a back view of a housing in accordance with the present invention, respectively.
Figure 3B:
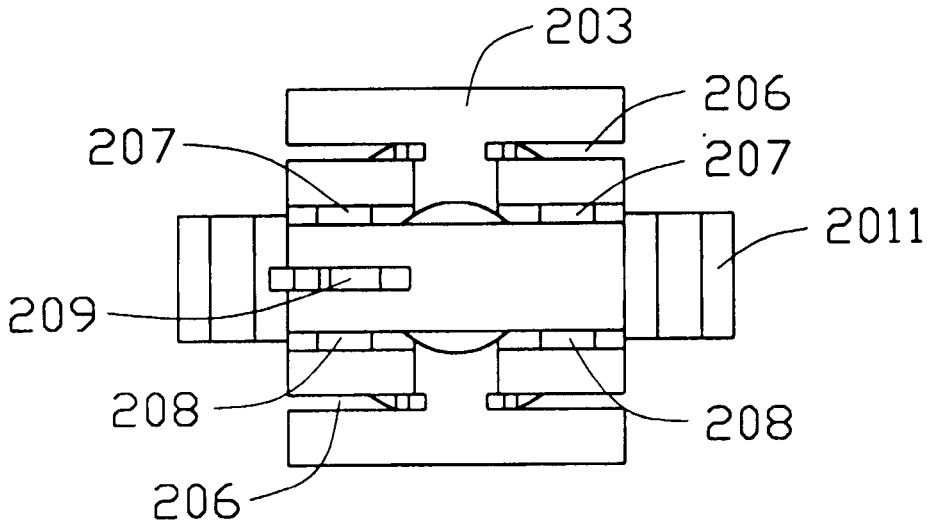

Referring to FIGS. 2, 3A and 3B, each electrical connector 2 comprises a housing 20 having a front portion 201, and a set of contacts 3. From the front portion 201, the housing 20 forms a pair of projection portions 2011 extending to both sides thereof, a front projection 210 extending forward therefrom defining an insert hole 202 therethrough, a pair of fastening portions 203 extending symmetrically from a top and a bottom of the front portion 201, and a block 204 extending rearwardly from the front portion 201. Two pairs of recesses 2061 are defined between the front portion 201 and the fastening portions 203. A flute 2031 is defined in a distal surface of each fastening portions 203 for engaging with the corresponding projection 121 of the locking arm 12.

A pair of first groove 206 is defined between each fastening portions 203 and the block 204. The block 204 comprises a pair of side portions 205, a pair of second groove 207, a pair of third groove 208, a pair of grounding groove 209 being defined therein. A pair of opening 2041 extend through the block 204 and between the side portions 205. These grooves 206, 207, 208 and 209 are defined to longitudinally through, the side portions 205 paralleled to the axis of the insert hole 202. A plurality of contacts 3 are receiving in these grooves.

Referring to FIG. 2, a set of contacts 3 comprises a first contact 31 received in the first groove 206, a second contact 32 received in the first groove 206, a grounding contact 34 received in the grounding groove 209, and a pair of switch contacts 33 received in the second and the third groove 207, 208 respectively. Each contact 31, 32, 33, and 34 respectively defines a base portion 310, 320, 330, and 340, a pair of sidebars 312, 322, 332, and 342 extending from the base portions 310, 320, 330, and 340, and a contacting portion 313, 323, 333, and 343 extending from one sidebar 312, 322, 332, and 342. A pair of engaging patches 3121, 3221, 3321, and 3421 are respectively positioned on the ends of the sidebars 312, 322, 332, and the sidebar 342. A mating arm 311, 321, and 341 respectively inclinedly depends from the base portion 310, 320, and 340 of the contacts 31, 32, and 34. A contact bar 314, 324 bends respectively from the base portion 310 and the mating arm 321.

Figure 4A:
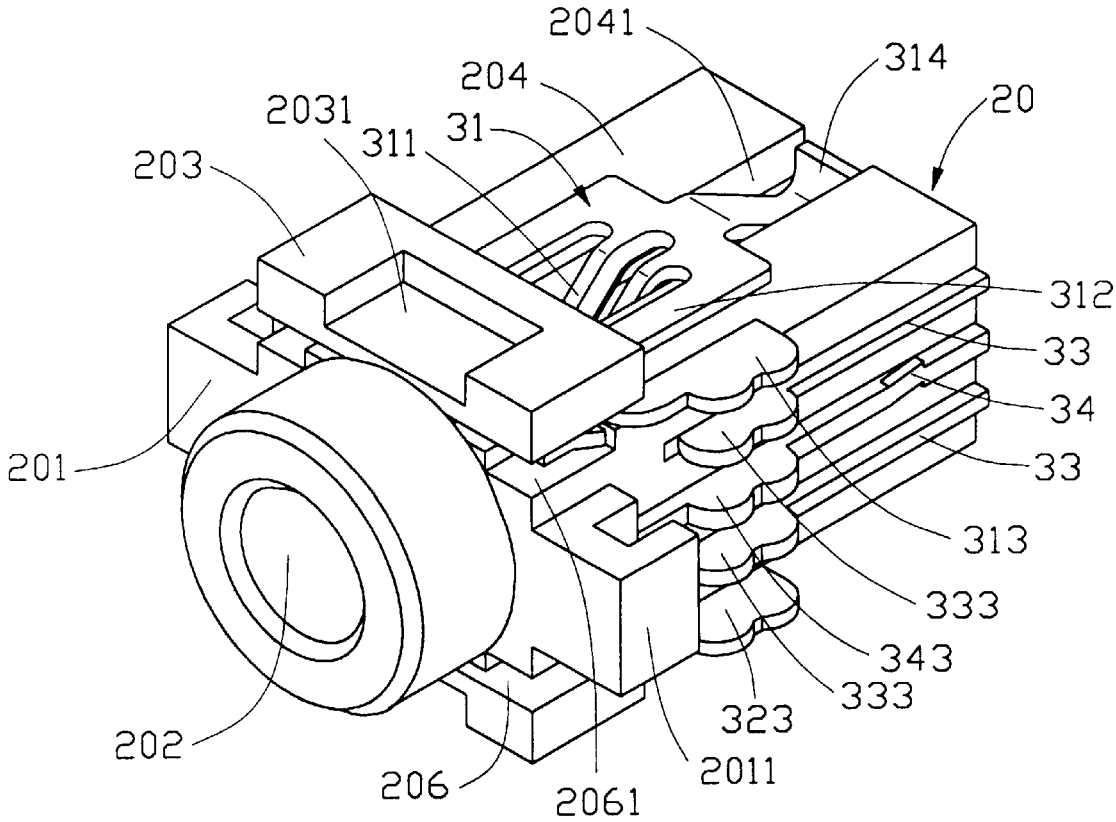
FIGS. 4A and 4B are respectively an assembled view of the electrical connector of FIGS. 2 and a perspective view of the electrical connectors of FIG. 2 assembled in a main frame of FIG. 1.

When the contacts 3 are inserted into the housing 20, Referring to FIG. 4A, the sidebars 312, 322 of the first contact 31 and the second contact 32 are firstly inserted into the first grooves 206 of the housing 20, the engaging patches 3121 and 3221 clipping into the recesses 2061. Secondly, the first and the second contacts 31, 32 are pressed into the block 204. The switch contacts 33 are inserted into the second groove 207 and the third groove 208, and the grounding contact 34 is received in the grounding groove 209. Furthermore the mating arms 311, 321 are positioned in the insert hole 202 by extending through the opening 2041. When a mating plug (not shown) is not inserted into the insert hole 202, the contact bar 314 can not contact with the switch contact 33, while the contact bar 324 can contact with the switch contact 33. When a mating plug is inserted into the insert hole 202, the contact bar 324 disengages with the switch contact 33, while the contact bar 314 engages with the switch contact 33 by the pivoting of the mating arms 311, 321. The contacting portions 313, 323, 333, and 343 project from the side portion 205 of the housing 20 for engaging with the terminals 5.

Figure 4B:
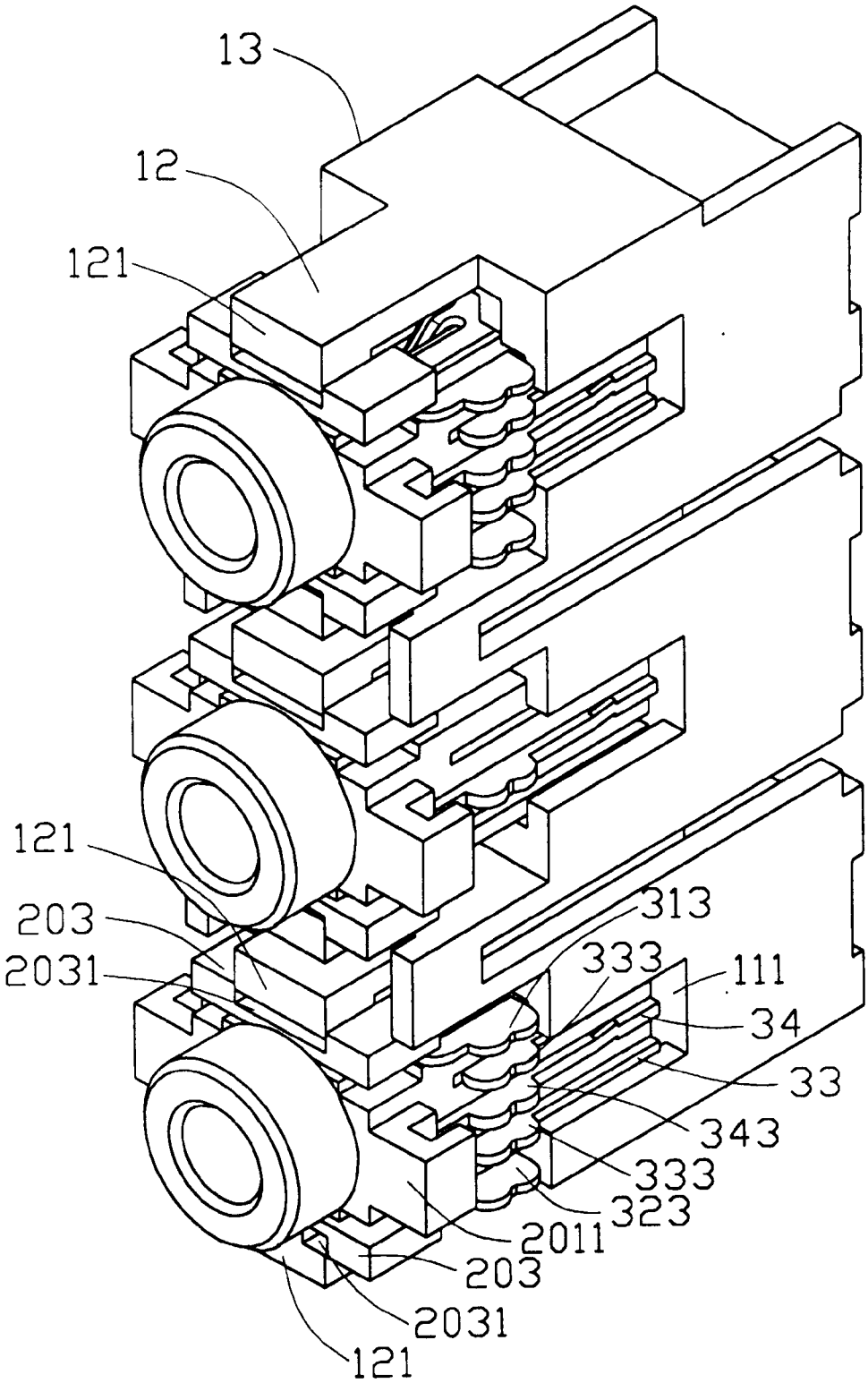
Figure 5A:
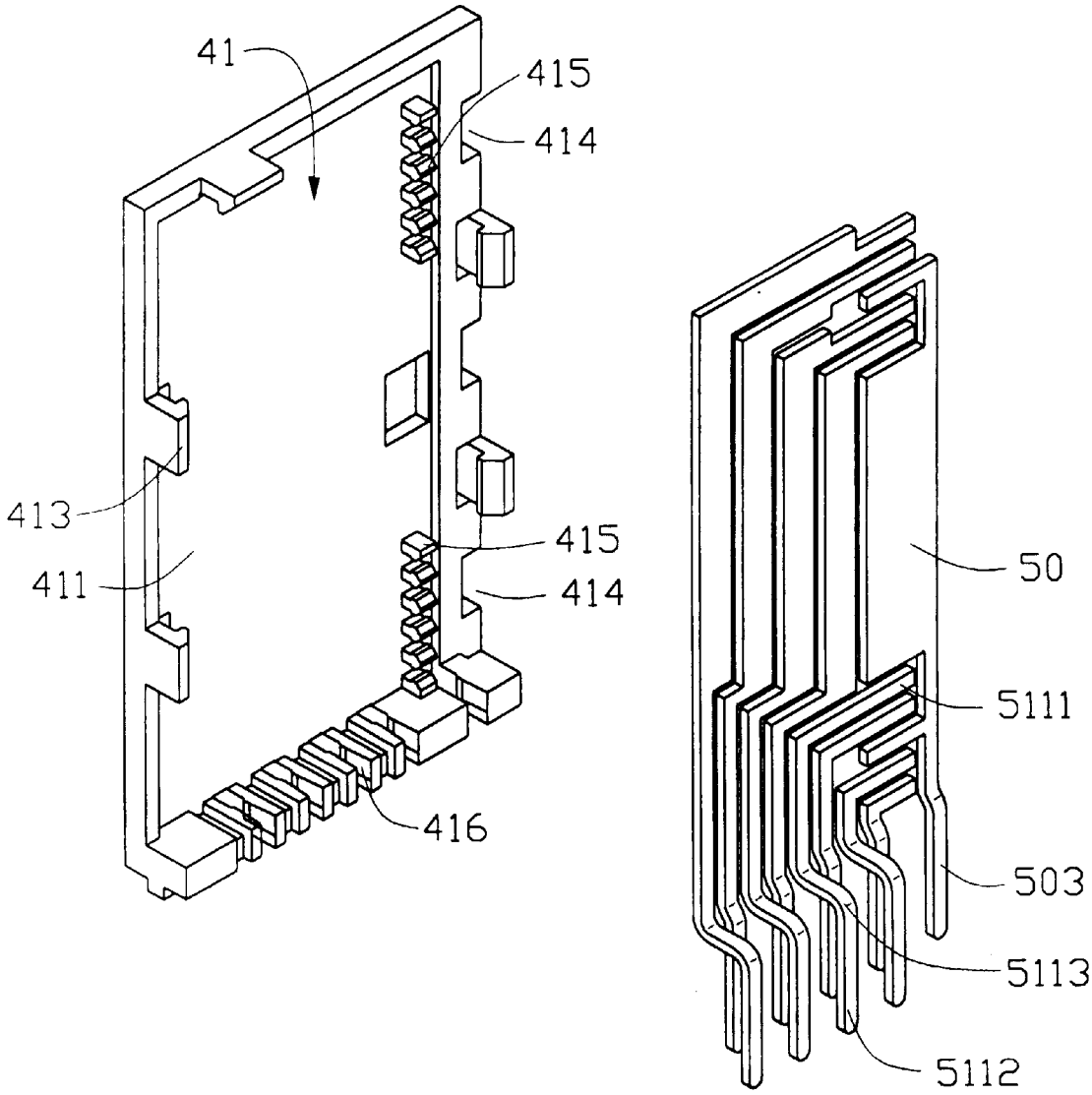
FIGS. 5A and 5B are respectively on unassembled and an assembled perspective view of a first side cover and a relational part of the terminals in accordance with the present invention respectively.
Figure 5B:
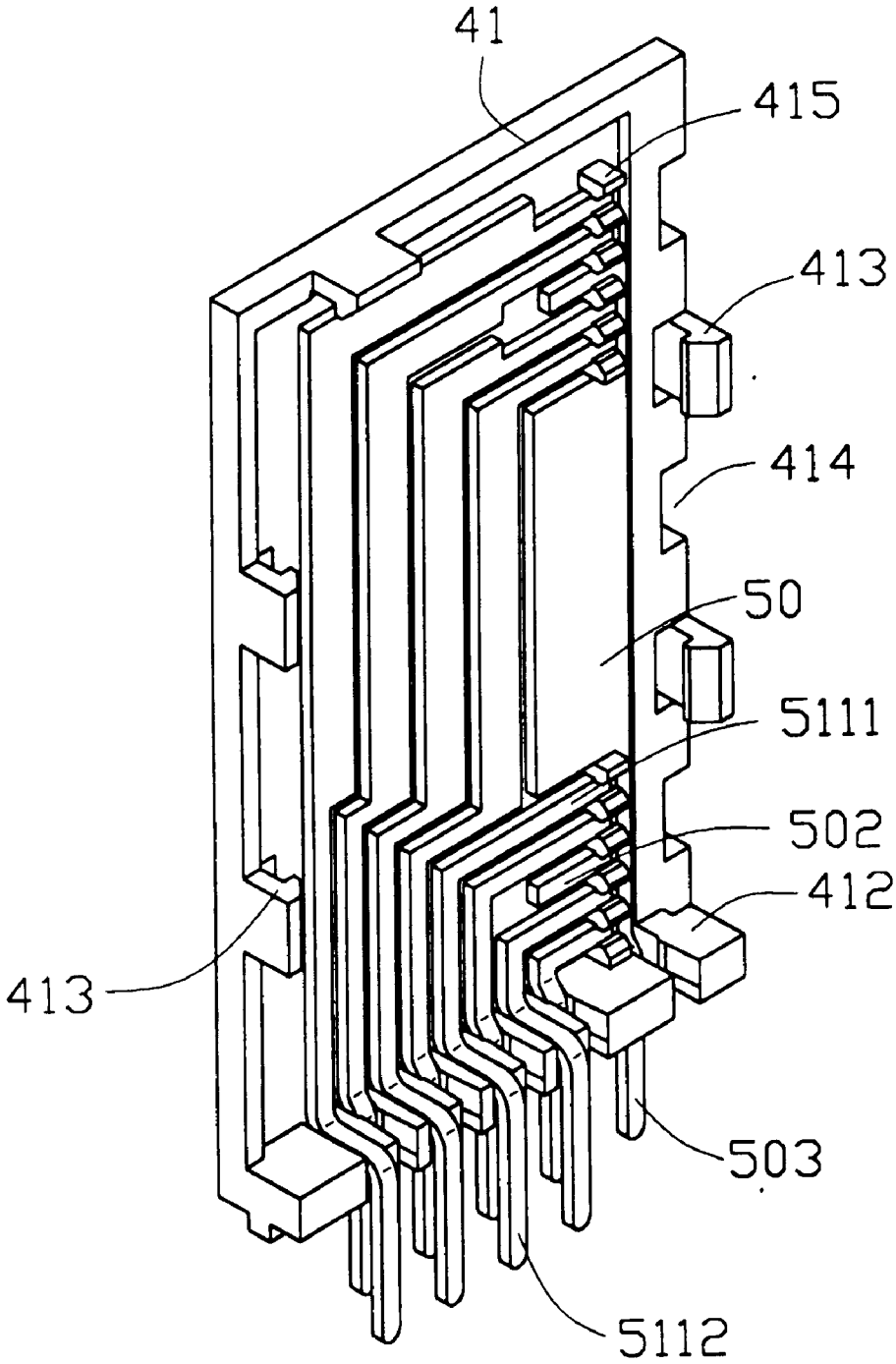

Referring to FIG. 4B, three electrical connectors 2 are partly inserted into the receiving cavities 11 of the main frame 1, the flutes 2031 of the housings 20 engaging with the projections 121 of the locking arms 12. The base portion 330, 340 abut against an end of the gap 111 of the main frame 1 thereby preventing the electrical connectors 2 from inserting into the main frame 1 completely. The contacting portion 313, 323, 333, and 343 project outside of the sidewall 13 of the main frame 1. Furthermore the contacting portion 313, 323, 333, and 343 of the contacts 3 of the upper and the lower electrical connector 2 are positioned on a right side of the electrical connector assembly for engaging with the terminals 5, respectively, while the contacting portion 313, 323, 333 of the middle electrical connector 2 are positioned on a left side thereof. The contacting portion 343 of the middle electrical connector 2 is positioned to the right side of the electrical connector assembly.

Referring to FIGS. 5A–7B, both the first side cover 41 and the second side cover 42 comprise respectively a main body 411, 421, a plurality of latches 413, 423 extending from the main body 411, 421, several notches 414, 424 defined on edges of the main body 411, 421, a plurality of positioning blocks 415, 425 formed from an inner wall (not labeled) of the main body 411, 421, and a plurality of spacing slots 416, 426 formed in a bottom edge 412, 422 of the main body 411, 421.

The terminals 5 are located in the first and the second side covers 41,42 by fixing between the positioning blocks 415, 425 and the spacing slots 416, 426. The terminals 5 comprise a grounding terminal 50, a first group terminal 51, a second group terminal 52, and a third group terminal 53. The grounding terminal 50, the first group terminal 51 and the second group terminal 52 are position in the first side cover 41, respectively, and the third group terminal 53 is positioned in the second side cover 42.

Figure 6A:
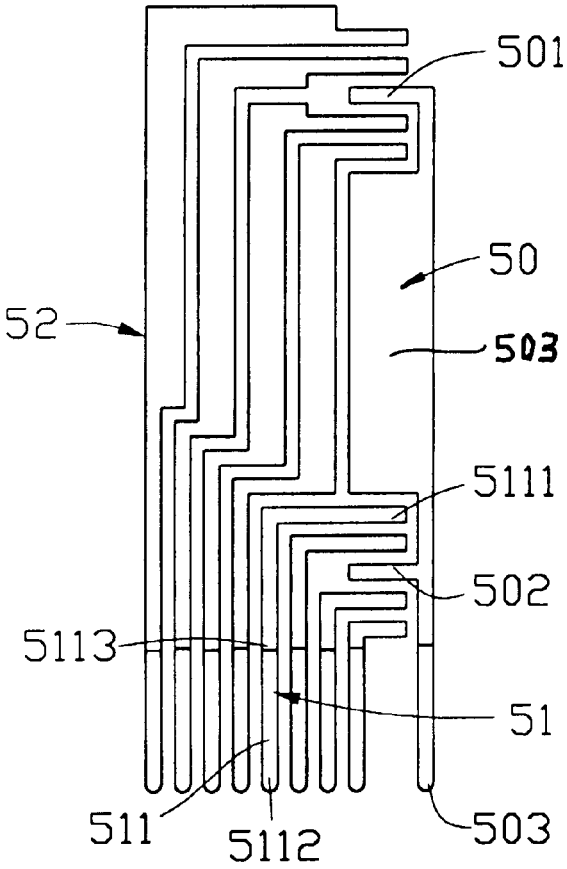
FIGS. 6A and 6B are a front and side view of the terminals shown in FIGS. 5A and 5B.
Figure 6B:
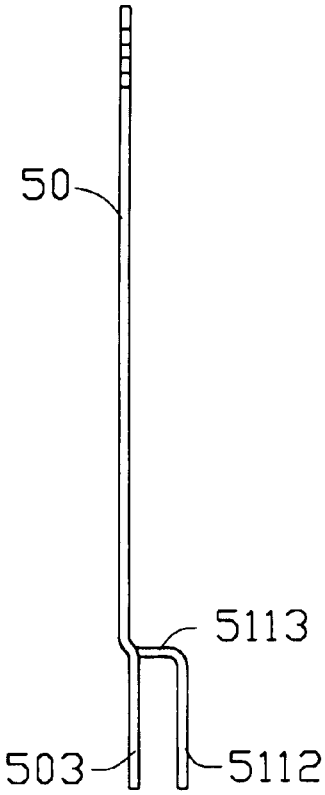

Referring to FIGS. 6A and 6B, the grounding terminal 50 defines a first contact section 501 engaging with the contacting portion 343 of the upper electrical connector 2, a tail 503 extending from the other end opposite to the first contact section 501 and a second contact section 502 engaging with the contacting portion 343 of the lower electrical connector 2.

Furthermore, each of the terminal group 51, 52, and 53 has the same number of terminals, and each terminal has a similar construction. Therefore, only a representative terminal 511 of the first group terminal 51 will be described in details. Each terminal 511 of the first group terminal 51 has a square cross section. The terminal 511 each comprise a contact section 5111 engaging with a contacting portion 313, 323, and 333 of the contacts 3, a bending section 5113 extending perpendicularly with the contact section 5111, and a soldering section 5112 extending vertical from the bending section 5113. The contact section 5111 is not co-planar with the soldering section 5112 due to the bending of the bending section 5113. Adjacent terminals 511 have bending section 5113 of different lengths, said lengths alternating between long a short, whereby the soldering section 5112 are spaced for the apart and a pattern of holes (not shown) for fixing the soldering section 5112 in the printed circuit board (not shown) are not too dense. In addition, the said holes (not shown) of the board can be made more easily, thereby lowering manufacturing cost. Additionally, the EMI emitted by these terminals is also reduced.

Figure 7A:
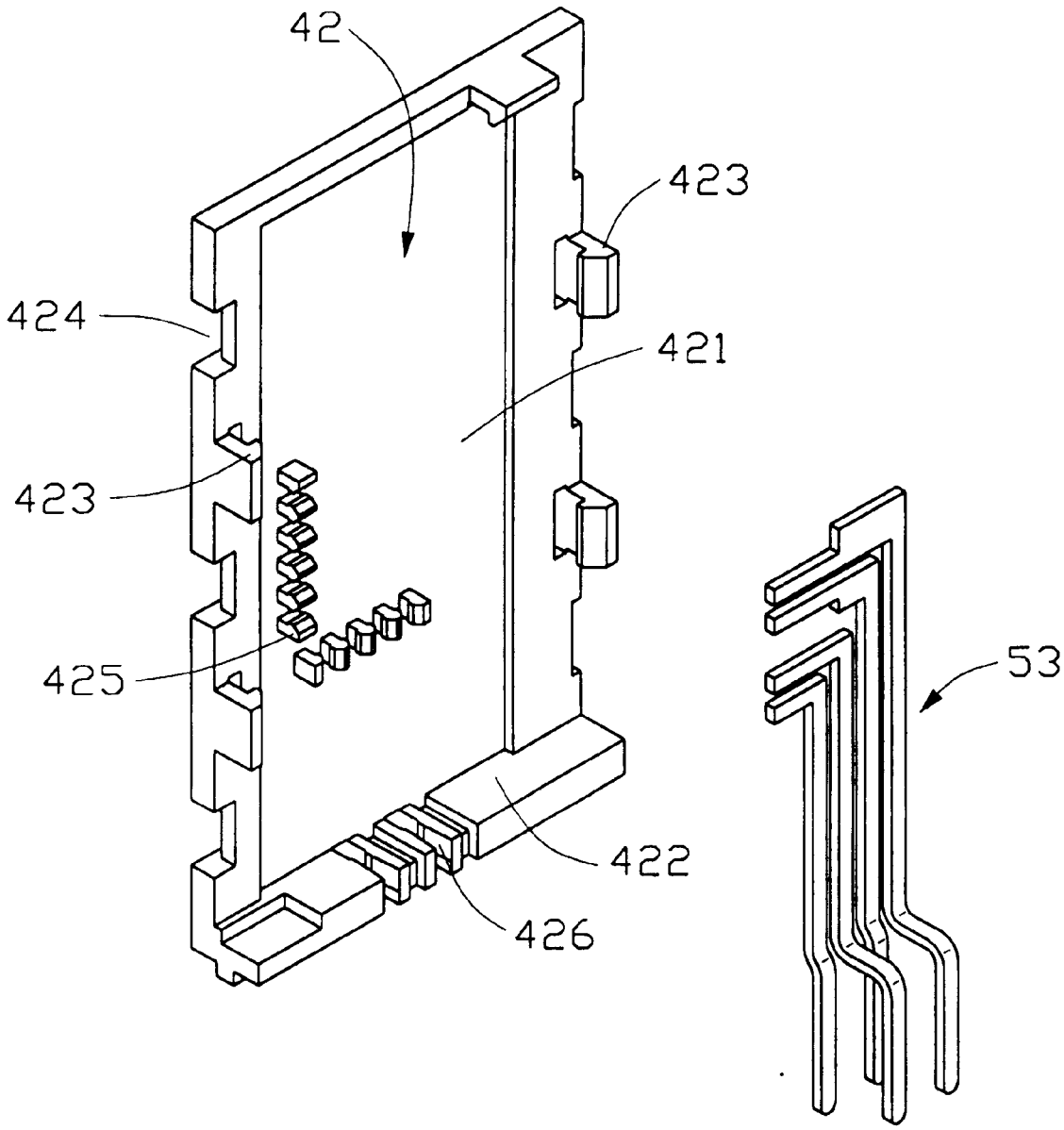
FIGS. 7A and 7B are respectively an unassembled and an assembled perspective view of a second side cover and the relational others terminals in accordance with the present invention.
Figure 7B:
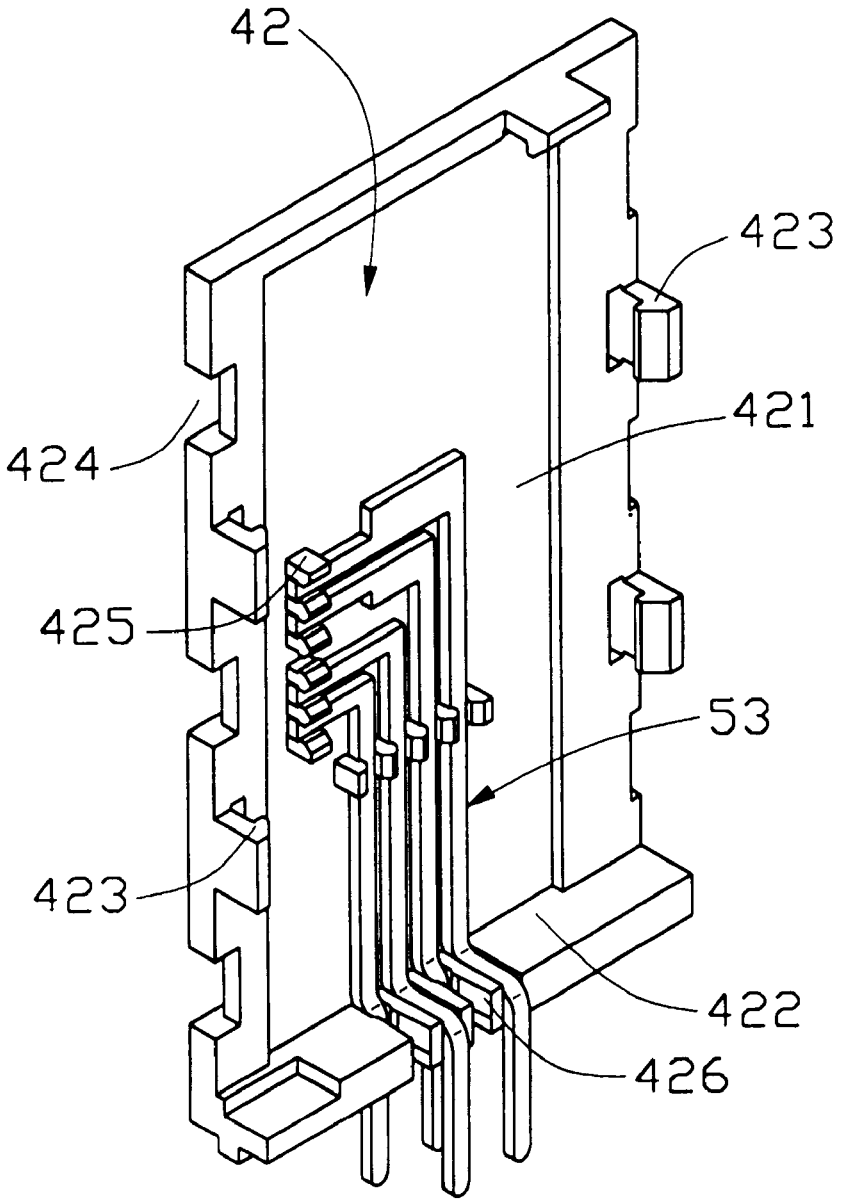
Figure 8:
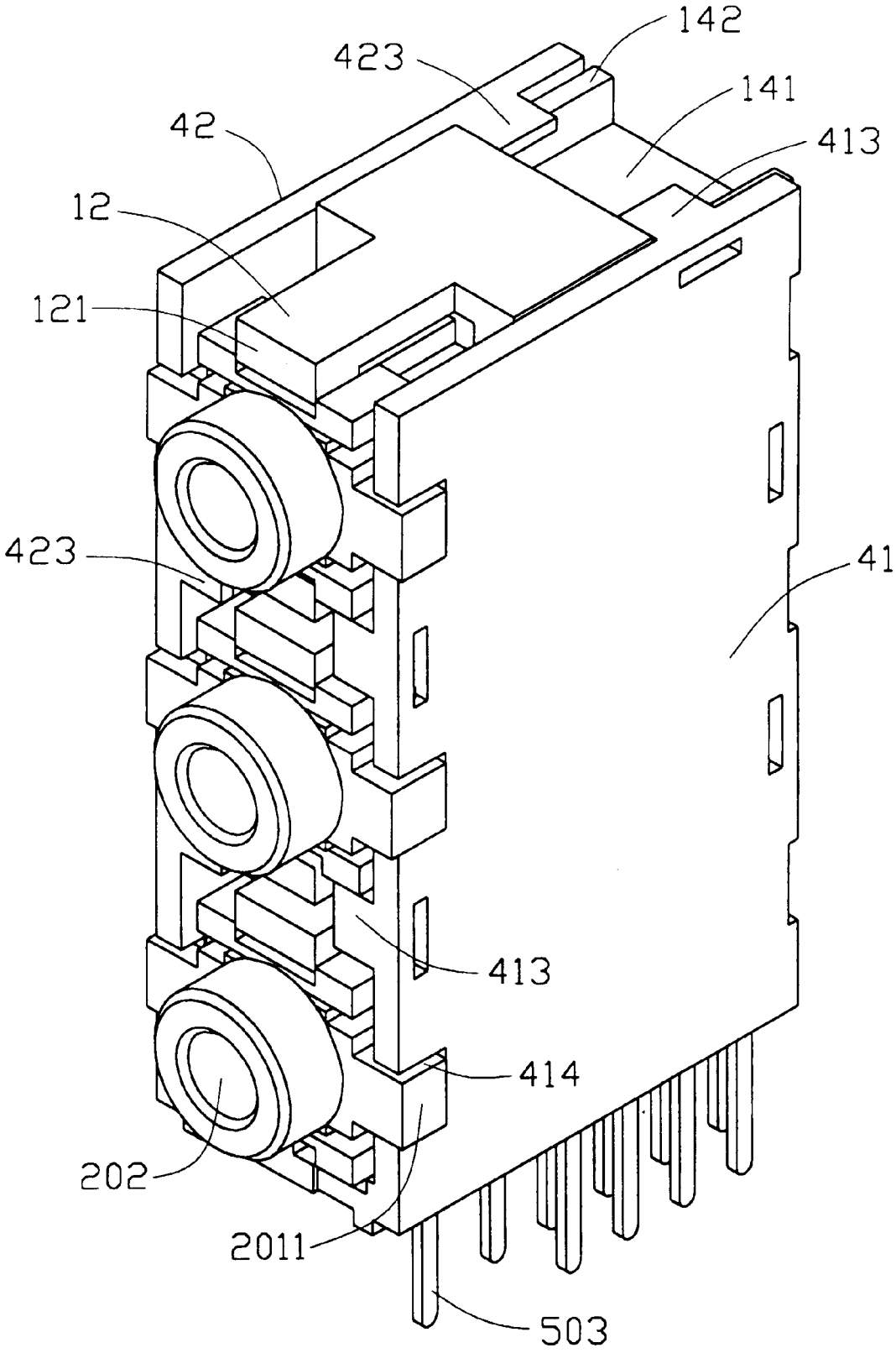
FIG. 8 is an assembled perspective view of the receptacle electrical connector assembly but without a shield in accordance with the present invention respectively.
Figure 9:
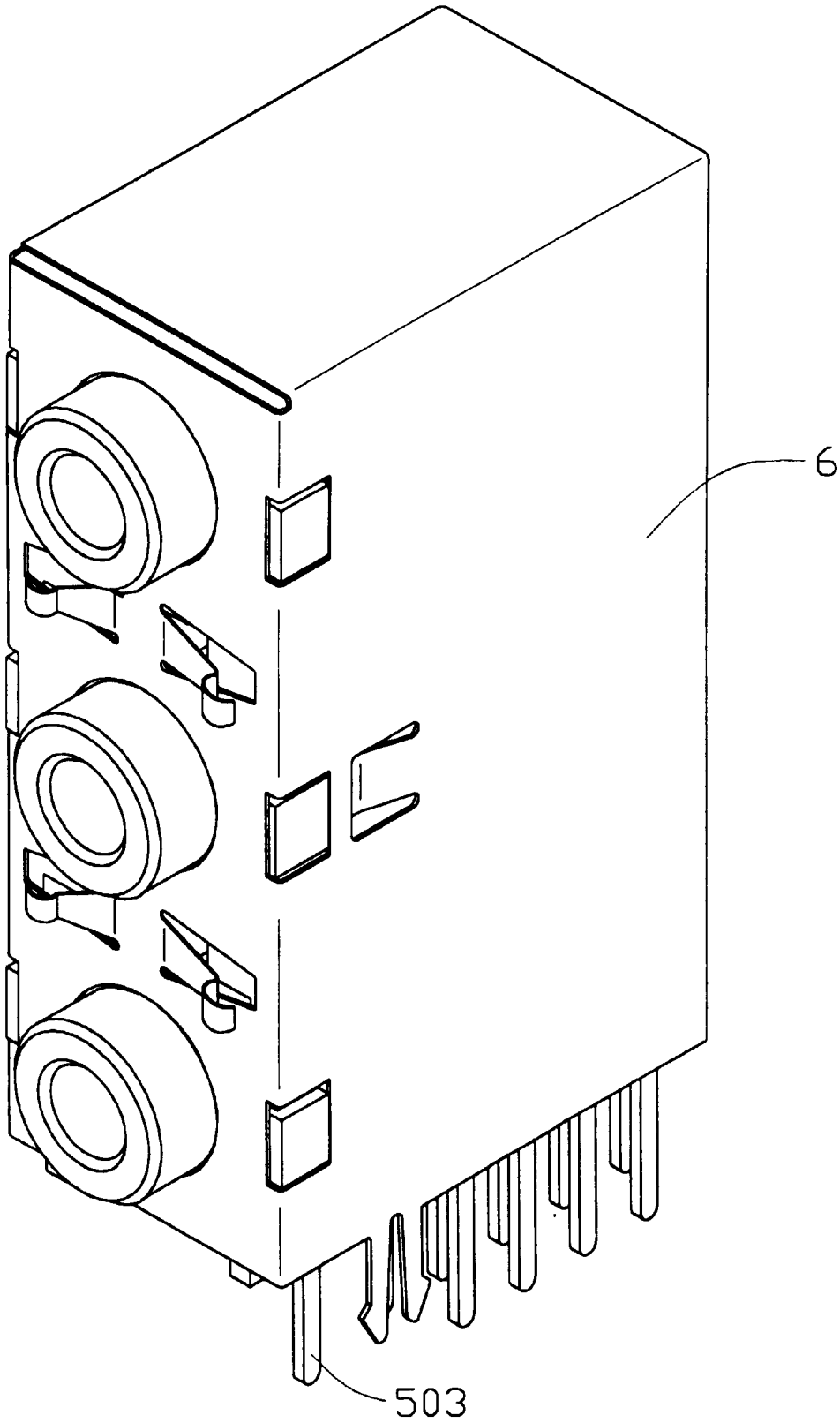
FIG. 9 is an assembled view of the receptacle electrical connector assembly in accordance with the present invention.

Also Referring to FIGS. 6A and 7A, the grounding terminal 50, the first group terminal 51 and the second group terminal 52 are stamped connected to one carrier strip (not shown). The third group terminal 53 is similarly stamped with one carrier strip (not shown). The design of each terminal group facilitates processing and assembly and minimizes use of carrier material. Referring to FIGS. 1, 8 and 9, in assembly, the first side cover 41 and the second side cover 42 are assembled with the electrical connectors 2 and the main frame 1 by the latches 413, 423 and the notches 414, 424 of the side covers 41 and 42 engaging with the complementary clipping bars 131, the indentations 132, the recess 141, and the projecting portions 2011. The shield 6 is then assembled to an outside of the assembly comprising the electrical connectors 2, the side covers 41, 42 and the main frame 1 to form a complete receptacle electrical connector assembly.

It is noted that referring to FIGS. 1 and 6A, the contact portion 343 of the grounding contact 34 of the middle connector 2 is engaged with the third contact section 503 of the grounding terminal 50. In other words, the grounding contacts 34 of all the three upper, middle and lower connectors 2 are commonly grounded to the same grounding terminal 50. Based on this arrangement, the grounding terminal 50 needs three different level contact sections 501, 502 and 503 to contact the corresponding grounding contacts of the different connectors 2, and thus the grounding terminal 50 cannot help but be positioned at the first position within the terminal groups for not interfering with the other (signal) terminals which positionably extend at different levels. The aforementioned arrangement of the terminal groups is also a feature of the invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle electrical connector assembly comprising:

a main frame having three receiving cavities;

an upper, a lower, and a middle electrical connectors securely received in corresponding receiving cavities of the main frame, each electrical connector having a housing and a plurality of contacts received in the housing, each housing comprising a pair of side projection portions, a front projection, and an insert hole defined through the front projection, each plurality of contacts comprising a first contact, a second contact, a grounding contact, and a pair of switch contacts, each contact defining a base portion, a pair of sidebars extending from the base portion, and a contacting portion extending from one of the two sidebars, the contacting portions of the grounding contacts of the three electrical connectors projecting from the same side portion of the housings, the contacting portions of the contacts of the middle electrical connector projecting from the other side portion of the associated housing;

a first side cover and a second side cover for assembling on both sides of the main frame;

a first group of terminals, a second group of terminals, and a grounding terminal mounted on the first side cover and a third group of terminals mounted on the second side cover, each terminal engaging with the contacting portion of a corresponding contact; and a metal shield covering a front of the receptacle electrical connector assembly;

wherein: each housing defines two pairs of first grooves, a pair of second grooves, a pair of third grooves, and a pair of grounding grooves for receiving the first contact, the second contact, one of the switch contacts, the other of the switch contacts and the grounding contact, respectively; each of the first and second contacts has a mating arm extending into the insert hole of the housing;

wherein an engaging patch is positioned on an end of the sidebar of each contact, a mating arm and a contact bar inclinedly depend from the base portion of the first contact, and a contact bar depends from the mating arm of the second contact;

wherein each terminal comprises a contact section engaging with the contacting portion of the contact and a soldering section, and two adjacent soldering sections of each group of terminals are offset from each other;

wherein the main frame has three pairs of opposing locking arms, and each housing has a top and a bottom fastening portion to engage with corresponding locking arms;

wherein the first side cover and the second side cover each comprise a main body, a plurality of latches extending from the main body, a plurality of notches defined on edges of the main body, a plurality of positioning blocks formed from an inner wall of the main body, and a plurality of spacing slots formed in a bottom edge of the main body.

* * * * *